US007603816B1

(12) United States Patent
Hohmann, Jr.

(10) Patent No.: US 7,603,816 B1
(45) Date of Patent: Oct. 20, 2009

(54) COMBINED SILL SEAL AND TERMITE SHIELD (SSTS)

(75) Inventor: Ronald P. Hohmann, Jr., Hauppauge, NY (US)

(73) Assignee: MiTek Holdings, Inc., Wilmington, DE (US)

( * ) Notice: Subject to any disclaimer, the term of this patent is extended or adjusted under 35 U.S.C. 154(b) by 368 days.

(21) Appl. No.: 11/236,136

(22) Filed: Sep. 27, 2005

(51) Int. Cl.
*A01K 13/00* (2006.01)

(52) U.S. Cl. ..... 52/101; 52/309.1; 52/520; 52/300; 43/132.1

(58) Field of Classification Search ..... 52/300, 52/310, 101, 520; 43/124, 132.1; 428/304.4, 428/315.5, 318.4, 319.1, 318.8
See application file for complete search history.

(56) References Cited

U.S. PATENT DOCUMENTS

| | | | | |
|---|---|---|---|---|
| 2,674,765 | A * | 4/1954 | Tennison | 52/101 |
| 2,952,938 | A * | 9/1960 | Abrams | 52/517 |
| 3,385,016 | A | 5/1968 | Crom | 52/224 |
| 4,189,877 | A | 2/1980 | Jentoft et al. | 52/58 |
| 4,456,649 | A * | 6/1984 | Clarke | 428/74 |
| 4,528,787 | A | 7/1985 | Rittinge | 52/169.5 |
| 5,091,235 | A | 2/1992 | Vergnano | 428/192 |
| 5,097,641 | A * | 3/1992 | Hand et al. | 52/101 |
| 5,303,523 | A * | 4/1994 | Hand et al. | 52/101 |
| 5,732,519 | A | 3/1998 | Leek | 52/293.3 |
| 5,802,779 | A | 9/1998 | Hulls et al. | 52/101 |
| 5,904,007 | A * | 5/1999 | Trapnell | 52/101 |
| 6,235,136 | B1 | 5/2001 | Kittson et al. | 156/166 |

(Continued)

OTHER PUBLICATIONS

York Manufacturing Inc. *Catalog Sheets for the YorkShield Product Line*, 10 pp. (Sanford, ME; undated).

(Continued)

*Primary Examiner*—Richard E Chilcot, Jr.
*Assistant Examiner*—Anthony N Bartosik
(74) *Attorney, Agent, or Firm*—Siegmar Silber, Esq.

(57) ABSTRACT

Sill seal and termite shield (SSTS) devices are disclosed. The SSTS devices for residential housing are shown for poured concrete, masonry block, and frost protected shallow foundations. The polymeric foam pad of the SSTS device seals the rough surface atop the foundation wall. For the termite shield function, the SSTS devices use a metallic web—either of foil or of an impenetrable screen—or a nonmetallic web—either of plastic sheet or of impenetrable scrim. The termite shield or barrier layer is shown as adjacent to a weatherproofing membrane or as an interior layer of an polymeric laminate weatherproofing membrane. Hot melt adhesives attach the foam pad to the weatherproofing membrane and, where applicable, the barrier layer to the weatherproofing membrane. Pressure-activated, hot melt adhesives attach the SSTS device to the sill plate. A release sheet is applied forming a peel-and-stick device.

17 Claims, 10 Drawing Sheets

U.S. PATENT DOCUMENTS

| | | | | |
|---|---|---|---|---|
| 6,331,308 | B1 | 12/2001 | Van Voris et al. | 424/411 |
| 6,546,679 | B1 | 4/2003 | Bushberger | 52/169.14 |
| 6,578,332 | B2 | 6/2003 | Bushberger | 52/293.3 |
| 6,584,746 | B1 * | 7/2003 | Hohmann et al. | 52/513 |
| 6,676,779 | B2 * | 1/2004 | Hopkins et al. | 156/71 |
| 6,803,051 | B1 | 10/2004 | Voris et al. | 424/406 |
| 6,928,780 | B1 * | 8/2005 | Hohmann et al. | 52/513 |
| 6,945,000 | B1 * | 9/2005 | Hohmann et al. | 52/513 |
| 2002/0155305 | A1 * | 10/2002 | Peuramaki | 428/458 |
| 2003/0178121 | A1 * | 9/2003 | Hopkins et al. | 156/71 |
| 2004/0163332 | A1 * | 8/2004 | Raymond | 52/101 |
| 2006/0003148 | A1 * | 1/2006 | Zwynenburg et al. | 428/157 |

OTHER PUBLICATIONS

Protecto Wrap Company. *Product Installation Instruction*. 2 pp. (Denver, CO; undated).

Q'so Inc. *Product Data for Q-18-40 adhesive*. 2 pp. (Saginaw, TX; Dec. 5, 2002).

Q'so Inc. *Material Safety Data Sheet for Q-18-40 adhesive*. 3 pp. (Saginaw, TX; Dec. 5, 2002).

* cited by examiner

COMBINED SILL SEAL AND TERMITE SHIELD (SSTS)

BACKGROUND OF THE INVENTION

1. Field of the Invention

This invention relates to a dual-purpose device for sealing the space between a foundation and a sill plate and for providing a physical barrier against termites and other wood boring insects. The device has a portion thereof that adheres to the open face of the sill plate and acts as an impenetrable shield. More particularly, the invention includes a strip of polymeric material that provides sill sealing and precludes weather and insect penetration.

2. Description of the Prior Art

Before the introduction of seismic building codes, residential and small commercial structures were not required to have the sill plate bolted to the concrete foundation. In California, homes built before 1949 were not covered by any specific seismic building code. Upon seismic activity, in buildings which are not bolted to the foundation, the building structure may move on the foundation or even slip off the foundation. Such movement can cause extensive damage to the building and injury to the occupants. Buildings conforming to the seismic building codes have anchor bolts positioned at regular intervals around the perimeter of the foundation wall and extending upward therefrom. The anchor bolts pass through complementary openings in the sill plate and the sill plate is bolted down to the foundation.

Residential construction materials, such as flashings, seals and shields, are frequently revisited to resolve technical problems associated with adjacent materials. A case in point is the galvanic corrosion of aluminum flashings applied over alkaline-copper-quaternary (ACQ) treated woods. Similarly, adhesives having an asphaltic or a bitumen base have been known at ambient temperatures to weep from the installation site and stain adjacent concrete, vinyl or wood. In the cases cited concerns arise as to the life expectancy of the flashing and the aesthetics of the asphaltic-based adhesives. As will be seen herein, other considerations are materials meeting building code standards, utilizing labor-saving installation techniques, and adapting to various changes in the building construction industry.

In the past, residential housing foundations have largely and traditionally been poured concrete or masonry block constructs. To these foundations, wood framing is attached to anchor bolts embedded in the concrete at the top of the poured concrete foundation walls or in the mortar filling the cells of the masonry blocks.

Somewhat more recently an insulated foundation, known as a frost-protected shallow foundation (FPSF), has attracted attention. An FPSF provides protection against frost damage without the need for excavating below the frost line. An FPSF has insulation placed strategically around the outside of a foundation to direct heat loss from the building toward the foundation, and also to use the earth's natural geothermal energy.

The traditional foundations discussed above are protected from frost-heaving damage by placing the footing below the frost line. Because FPSF are protected from freezing by thermal insulation, bottoms of footings can be just twelve to sixteen inches below grade. This reduces excavation costs, making this an economical alternative for protecting foundations against frost damage. The insulation used in FPSF is commonly rigid expanded or extruded polystyrene foam suitable for below grade application and in compliance with ASTM C 578 Standard. FPSF can be used for both heated and unheated portions of a building.

It is well-known that in buildings constructed with wood in contact with concrete, the wood may be structurally degraded by action of one or more wood pests including, but not limited to termites, ants and other boring insects. In the past, two distinct, but not mutually exclusive, avenues to resolving this problems were followed. First, a chemical barrier utilizing insecticide-treated materials and, secondly, a mechanical barrier such as a metal foil construct.

In the 1990's, Battelle Memorial Institutes did extensive research on long-term insecticide-bearing barriers resulting in patents to Peter Van Voris et al., U.S. Pat. Nos. 6,803,051 and 6,331,308. For purposes of background data, these patents are incorporated herein by reference. These patents describe the binding of a pesticide-carrier mixture into a polymer matrix for long-term protection and provide a comprehensive review of this prior art.

Various construction practices become institutionalized quite rapidly. With this said, it is noted that by the time the Bushberger, infra, application was provisionally filed in 2000, a standard sill plate sealer was described as an elongated strip approximately 0.25 inches thick preferably made from a lightweight polyethylene foam.

In addition to the previously recited art and in preparing for this application, the following patents came to the attention of the inventors and are believed to be relevant to the further discussion of the prior art:

| U.S. Pat. No. | Inventor | Issue Date |
|---|---|---|
| 6,578,332 | Bushberger | Jun. 17, 2003 |
| 6,546,679 | Bushberger | Apr. 15, 2003 |
| 6,235,136 | Kittson et al. | May 22, 2001 |
| 5,802,779 | Hulls et al. | Sep. 8, 1998 |
| 5,732,519 | Leek | Mar. 31, 1998 |
| 5,091,235 | Verganos | Feb. 25, 1992 |
| 4,528,787 | Rittinge | Jun. 16, 1985 |
| 4,189,877 | Jentoft et al. | Feb. 26, 1980 |
| 3,385,016 | Crom | May 28, 1968 |

Bushberger—U.S. Pat. No. 6,578,332—Issued Jun. 17, 2003

Bushberger in U.S. Pat. No. 6,578,332 describes a foundation seal between the wooden floor deck and the home foundation. The seal is T-shaped with a peel-and-stick adhesive surface on the lower surface of the foundation seal and mounted atop a poured concrete foundation wall.

Bushberger—U.S. Pat. No. 6,546,679—Issued Apr. 15, 2003

Here, Bushberger in an earlier patent, provides a foundation protective arrangement utilizing a multi-layer rubberized asphaltic laminate attached to an insulated building foundation.

Rittson et al.—U.S. Pat. No. 6,235,136—Issued May 22, 2001

In U.S. Pat. No. 6,235,136, a water-resistant mastic membrane is described. Here the laminate is formed in situ with a fiber glass scrim applied with a resinous adhesive. In the application of materials a final layer of asphalt emulsion is sprayed on the exposed surface.

Hulls et al.—U.S. Pat. No. 5,802,779—Issued Sep. 8, 1998

Hulls et al., in their '779 patent, describe a physical barrier to control termites. The barrier is mounted between a foundation and a wooden building structure. The device includes a bait block of cellulosic material which may be inspected to ascertain termite activity, and, if such activity is detected, replaced by a termiticide-laden bait block.

Leek—U.S. Pat. No. 5,732,519—Issued Mar. 31, 1998

Leek teaches a one-piece foundation-to-frame connector having an S-shape configuration and, upon installation, is bolted to the concrete foundation and attached to the sill plate or mud sill. The device is primarily designed to retrofit buildings erected prior to those conforming seismic building codes.

Vergano—U.S. Pat. No. 5,091,235—Issued Feb. 25, 1992

Vergano '235 describes a sill wrap assembly for providing air infiltration barrier between the sill plate and the foundation wall. The wrap includes a batt of infiltration material laminated into a spun-bonded or woven polyolefin sheet.

Rittinge—U.S. Pat. No. 4,528,787—Issued Jul. 16, 1985

The U.S. patent to Rittinge comprises a timber base plate and an additional metal base plate with channels communicating with a cavity.

Jentoft—U.S. Pat. No. 4,189,877—Issued Feb. 26, 1980

This shows an earlier mounting on a vinyl strip a reinforcing material, such as a fiber-glass scrim with a foam insulative material bonded thereon. The device is designed for use as an expansion joint cover.

Crom—U.S. Pat. No. 3,385,016—Issued May 28, 1968

The Crom patent shows a waterstop-bearing pad which was part of the joint construction between the foundation and the wall of a liquid storage tank.

Various devices for sill sealing and various devices for providing a physical barrier to control termites are shown in the prior art. However, none of the prior art devices provide the combination of features shown hereinbelow in the disclosed device.

SUMMARY

In the description which follows, a sill seal and termite shield (SSTS) device is shown in detail. Recently constructed houses are built on foundations which extend below the frost penetration and are either placed on a poured concrete foundation (see the first and second embodiments) or on a masonry block foundation (see the third and fourth embodiments). The fifth embodiment shows a sill seal and termite shield device mounted on a frost protected shallow foundation as discussed in the foregoing introductory matter. All of these foundations present a rough surface atop the foundation wall that is sealed by a polymeric foam pad of the SSTS device. The first four embodiments attach the sill plate to the foundation using anchor bolts and attaching hardware, whereas the fifth relies on adhesive to attach the sill plate.

The termite shield function of the SSTS devices is also described hereinbelow. The function is accommodated by a metallic web—either of foil or of an impenetrable screen—or a nonmetallic web—either of plastic sheet or of impenetrable scrim. Furthermore, the termite shield, which is termed herein a barrier layer, is shown as adjacent to a weatherproofing membrane or as an interior layer of an elastomeric composite weatherproofing membrane. The hot melt adhesives layers are of key importance in the various embodiments described herein below. The hot melt adhesives attach the foam pad to the weatherproofing membrane and, where applicable, the barrier layer to the weatherproofing membrane. Other pressure-activated, hot melt adhesives attach the SSTS device to the foundation wall and the sill plate to the SSTS device. For ease of installation, removable release sheets, preferably silicone treated, are optionally employed to convert the SSTS device hereof to a peel-and-stick device.

OBJECTS AND FEATURES OF THE INVENTION

It is an object of the present invention to provide a combined sill seal and termite shield that is readily installed utilizing a pressure-activated, hot melt adhesive which, upon activation, strongly adheres to the rough and porous surfaces of concrete and masonry block.

It is a further object of the present invention to have a combined sill seal and termite shield with a polymeric foam seal pad and one or more laminae thereon, which laminae include at least one that is impenetrable by wood boring insects.

It is another object of the present invention to provide a combined sill seal and termite shield system using an insect impenetrable web and a polymeric membrane in a system free of bituminous or asphaltic coatings.

It is yet another object of the present invention to provide a labor-saving metal foil and polymeric membrane system which utilizes peel-and-stick components that are easy and economical to install in residential or commercial construction.

It is still yet another object of the present invention to provide a combined sill seal and termite shield system which operates cooperatively with other building components and accessories such as insulation and waterproofing membranes.

It is a feature of the present invention that the hot melt adhesive hereof is compatible with waterproofing membranes containing ketone ethylene ester and meets industry flammability standards.

It is another feature of the present invention that one polymeric membrane hereof is highly, ultra-violet resistant and the membrane includes an embedded woven or non-woven glass fiber layer to preclude infestation and to enhance tear and puncture resistance.

It is yet another feature of the present invention that, upon installation, the foam layer sealing the sill plate obviates the use of sealants and caulks.

Other objects and features of the present invention will become apparent upon reviewing the drawing and reading the detailed description which follows.

BRIEF DESCRIPTION OF THE DRAWINGS

In the following drawings, the same parts in the various views are afforded the same reference designators.

Figure 1:
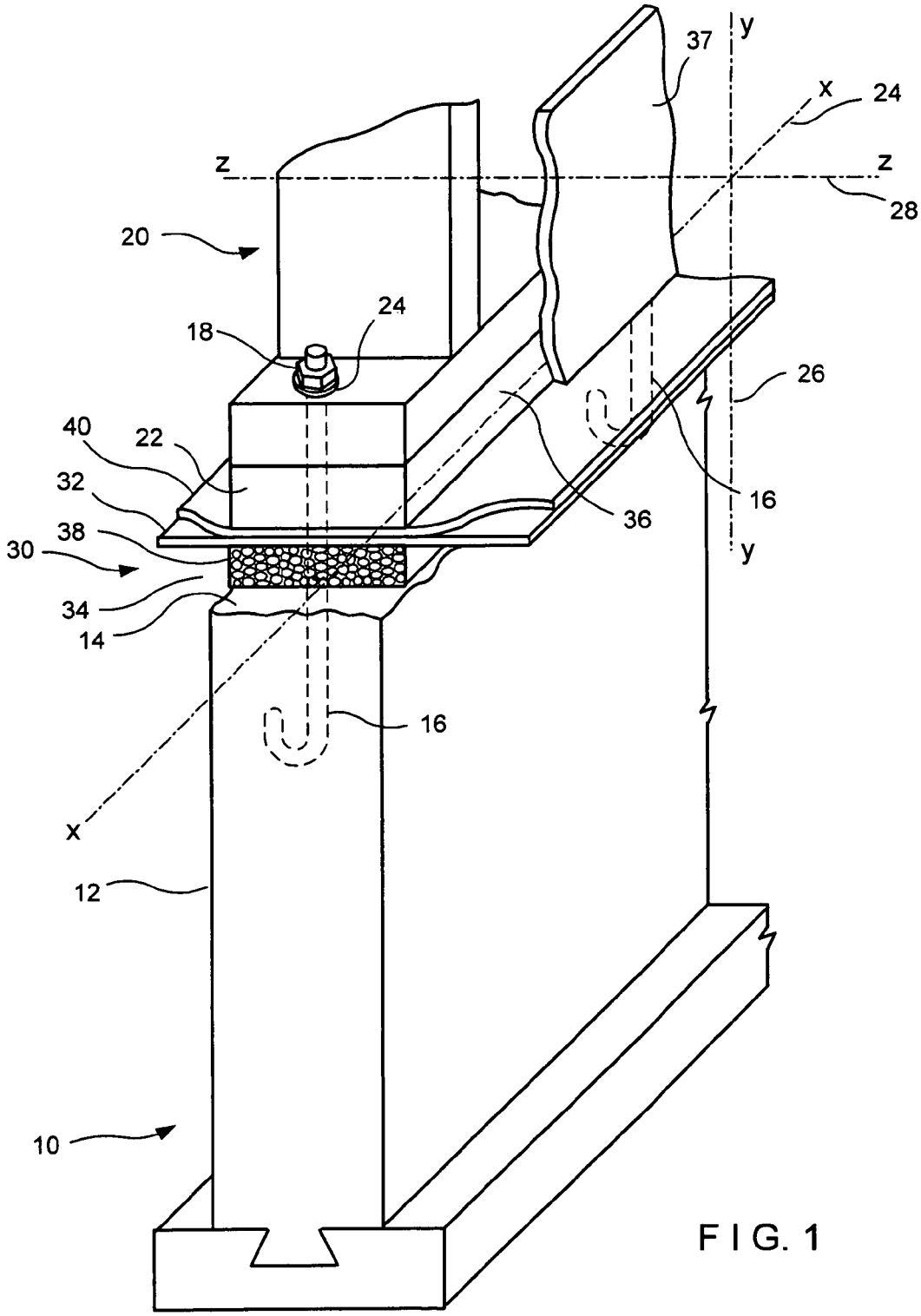
FIG. 1 is a perspective view of a first embodiment of a combined sill seal and termite shield (SSTS) of this invention and shows a poured concrete foundation therebelow and wood framing thereabove.
Figure 3:
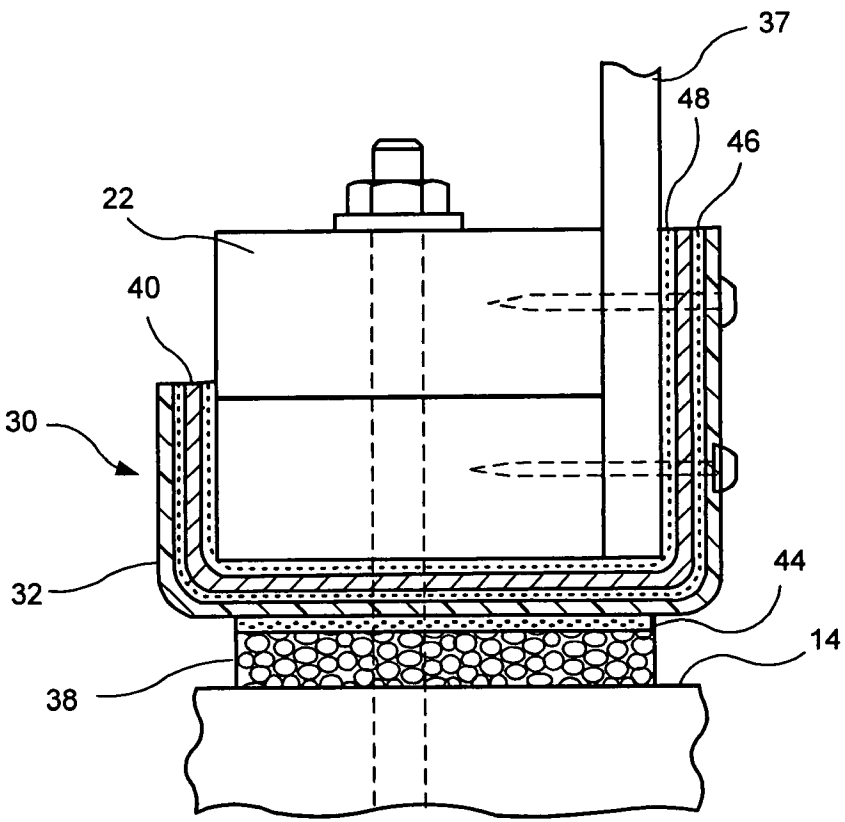
FIG. 3 is a cross-sectional schematic view of the SSTS of FIG. 2.
Figure 2:
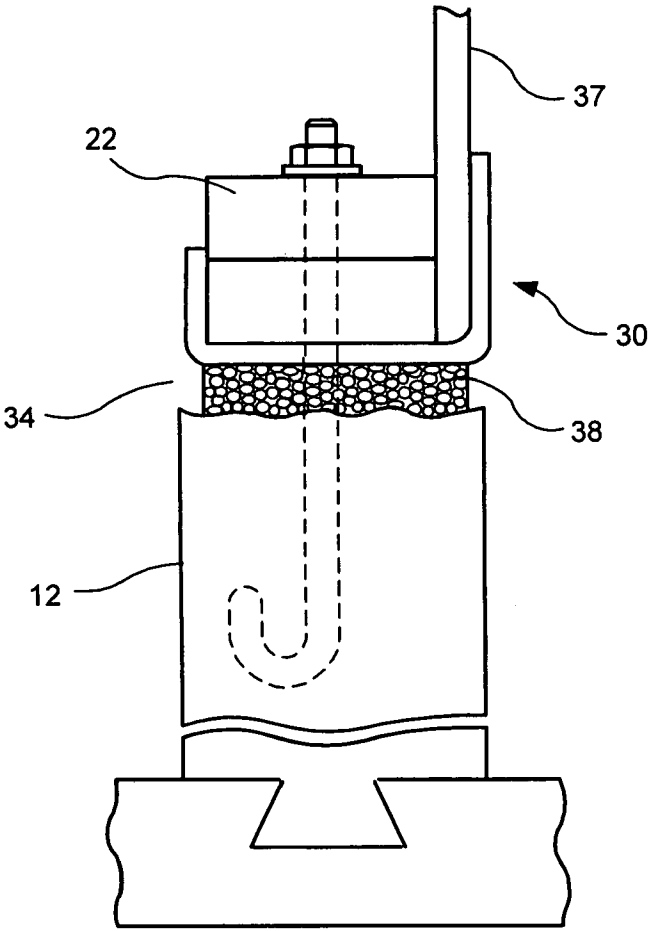
FIG. 2 is a cross-sectional view of the SSTS of FIG. 1 showing the positioning of the sill plate after the removal of the peel-and-stick release sheet.

DESCRIPTION OF THE PREFERRED EMBODIMENTS in the sill seal and termite shield (SSTS) of this invention, pressure-activated adhesives are used to attach a combination device of a foam sill seal; a waterproofing membrane, and a termite shield to at least one side of the sill plate and to the uppermost surface of the foundation. The SSTS is emplaced atop the foundation and receives thereon a sill plate. The weight of the sill plate pushes the foam cells of the sill seal into the irregular surface of the foundation wall and anchors the waterproofing membrane and the termite shield. The barrier function of the termite shield portion increases the longevity of the sill plate by precluding penetration thereof by termites and other wood boring insects. The weatherproofing membrane is of a high tensile strength material thereby improving tear and puncture resistance.

Referring now to FIGS. 1 through 4, the first embodiment of this invention in which a poured concrete foundation, referred to generally by the reference designator 10, is shown. In this embodiment, a foundation wall 12 is shown having an uppermost surface 14 with anchor bolts or J. bolts 16 embedded therewithin and attaching hardware 18. The uppermost surface 14, upon the curing of the poured concrete, dries to a rough and irregular finish. Thus, in the past, it has been somewhat problematic to provide a thorough seal between the uppermost surface 14 of the foundation wall 12 and the framing, referred to generally by the reference designator 20.

The lowermost member or sill plate 22 of the framing 20 has complementary apertures 24 therethrough to accommodate the anchor bolts 16 and, after disposition upon uppermost surface 14, the attaching hardware 18 secures the sill plate 22 to the foundation wall 12. The use of anchor bolt 16 and attaching hardware 18, most commonly a nut and washer, conforms to the requirements of most seismic building codes. This ensures that an earthquake or similarly drastic environmental condition will not result in the framework superstructure sliding off or being otherwise displaced from its position atop the foundation wall.

For purposes of this discussion, the exterior surface of the foundation wall 12 contains a horizontal line or x-axis 24 and an intersecting vertical line or y-axis 26. A horizontal line or z-axis 28 also passes through the coordinate origin formed by the intersecting x- and y-axes. In the discussion which follows, it will be seen that the sill seal and termite device 30 of this invention is constructed to completely seal the previously described juncture and to preclude termites and other wood boring insects from destroying the sill plate 22 of the framework 20.

Along the uppermost surface 14, in this embodiment, an SSTS device, referred to generally by the reference designator 30, is installed in an x-z plane as shown. The SSTS device 30 includes a waterproofing membrane 32 formed from an elongated web of elastomeric material. The waterproofing membrane 32 is constructed for embedment in joint 34 in an x-z plane and for adherence to the vertical sill plate surface 36 in an x-y plane. The waterproofing membrane 32 thereby sealing joint 34. In this preferred mode, it is seen that the membrane 32 is installed exterior to insulation 37.

In addition to membrane 32, the SSTS device 30 includes a foam pad or sill seal 38, and a barrier layer or termite shield 40. In this preferred mode, the termite shield 40 is constructed of a metallic material, such as copper foil; however, optionally a nonmetallic barrier such as a woven or nonwoven fiber glass layer or scrim may be used. The sill seal 38 is described in greater detail hereinbelow.

Figure 4:
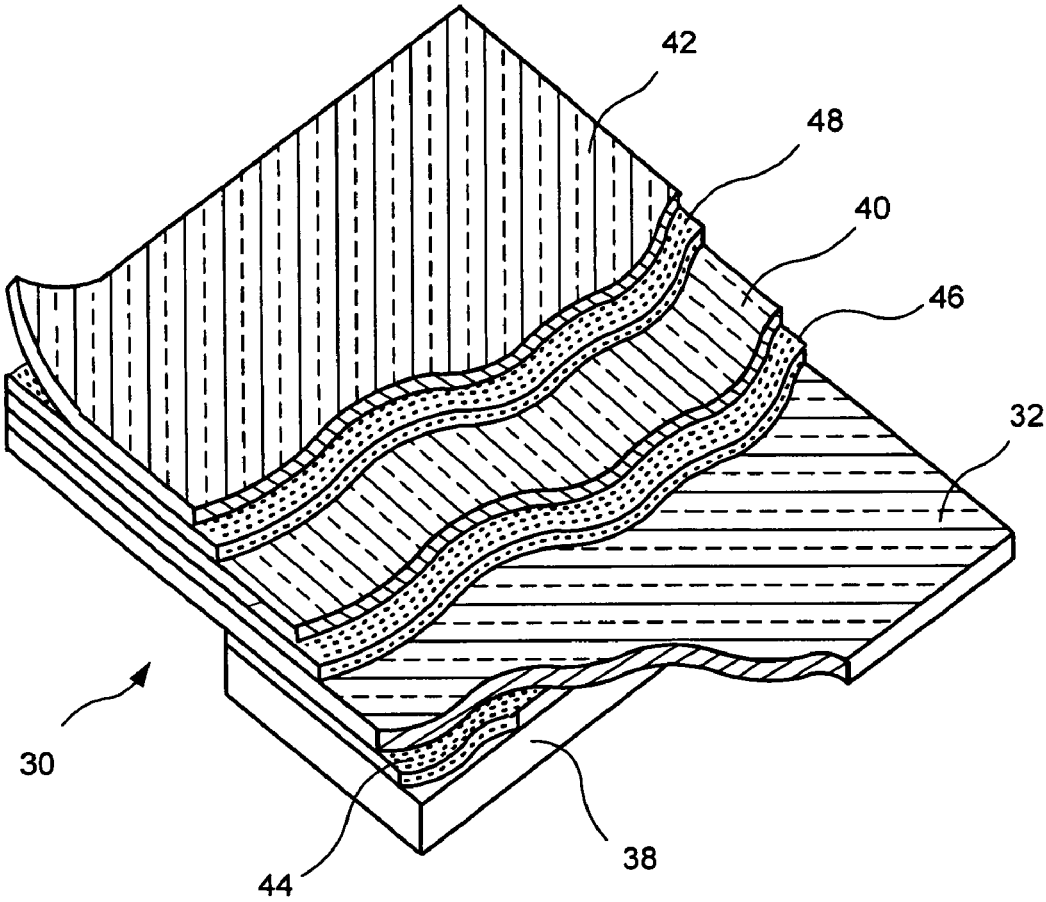
FIG. 4 is a perspective view of the uninstalled peel-and-stick SSTS device of FIG. 1 with successive laminae partially broken away to show details of the structure thereof.

Referring now to FIG. 4 the laminar structure of the SSTS device is shown uninstalled. Optionally, a release sheet 42 forms the SSTS device 30 into a peel-and-stick configuration. The peel-and-stick format simplifies installation and saves labor. The SSTS device utilizes hot melt adhesive technology for its construction and pressure-activated, hot melt adhesive for its application.

The laminar structure consists of a seven-layer arrangement. When viewing the sill seal/termite shield membrane from the foundation upper surface 14 and proceeding toward the sill plate 22 these layers are:

a. foam polymer sheet 38;

b. hot melt adhesive (foam-to-membrane adhesive layer) 44—APC #915;

c. waterproofing membrane—polymeric material 32;

d. hot melt adhesive (membrane-to-foil adhesive layer) 46 APC #915;

e. metal foil layer or barrier layer 40;

f. pressure-activated, hot melt adhesive 48 (foil-to-sill-plate layer)-APC #915; and g. release sheet 42 (removed upon installation).

Each layer is described in further detail below.

The foam polymer layer 38 is constructed from a polymeric foam and is preferably chosen from non-cross-linked polyethylene foam, low-density polyethylene foam, cross-linked polyethylene foam, and low-density polyethylene foam. Upon mounting atop the rough finished foundation wall the weight of the sill plate 22 and the framing structure 20 thereabove forces the cells of the foam into the interstices of the uppermost surface 14 of foundation wall 12. The closed cell structure of the foam layer 38 provides a competent seal against water, water vapor and weather.

The adhesive layers 44, 46 and 48 are selected from hot melt adhesive, solvent-based adhesive, water-based adhesive or of other types such as UV-cured polymer. The applied adhesive is preferably tacky, especially for adhesive layer 48 which is pressure activated. Suitable hot melt adhesives may contain such ingredients as polymers such as butyl rubber, styrene-butadiene-styrene (SBS), styrene-isoprene-styrene (SIS), styrene butadiene (SB), styrene-ethylene-butadiene-styrene (SEBS) and ethylenevinylacetate (EVA); resins such as those of the hydrocarbon and rosin types, natural and petroleum waxes, oils, and others. Solvent-based adhesives may contain ingredients such as those listed above, dissolved or dispersed in a solvent vehicle. Water based adhesives would normally be based on emulsions of polymeric materials. Suitable polymeric materials would include vinyl acetate and acrylic polymers and copolymers such as vinyl acetate acrylic, ethylene vinyl acetate as well as styrene acrylic, vinyl chloride acrylic, vinyl versatate and others.

From a production standpoint, the hot-melt adhesives for layers 44 and 46 may be simply melted for application and need not emit solvent which is an environmental pollutant and may require re-condensation. The adhesive may suitably be applied at a thickness of 0.001 inches to 0.1 inch, but is preferably applied at a thickness of 0.003 inches to 0.025 inches and most preferably at a thickness of 0.005 inches to 0.02 inches.

Referring again to FIG. 4, where the peel-and-stick SSTS device 30 configuration is employed, it further includes one or more hot melt adhesive layers which are formulated for pressure activation and compatibility with the waterproofing membrane 32 and the metal foil or barrier layer 40 adhered thereto. The adhesives described herein are particularly useful for peel-and-stick applications in building construction industry as such adhesives are readily pressure activated after the release sheet is removed. The adhesive is formulated so that, in case of fire, the coatings thereof will not contribute to smoke or accelerate flame spreading and thus do not require inorganic fillers which are known to interfere with the adhesive function. Also, the adhesives are formulated to have sufficient tackiness so that a durable bond between the membrane and the rough and porous surface of the concrete or masonry foundation is experienced. The adhesive on the sill seal/termite shield permits lapping of the lengths of sill seal/termite shield precluding the use of caulks and sealants at the lapped joints 59.

Incorporating by reference the Di Rado et al. patent, U.S. Pat. No. 5,106,447, the hot melt adhesive compositions of hot melt layer 56 may be prepared from 10 to 50 weight percent of an isotactic thermoplastic polybutene-1/ethylene copolymer containing from about 5.5 to about 10% by weight ethylene (polybutylene); 20 to 50 percent of a tackifier; 15 to 50 percent of an amorphous diluent having a softening point greater than 90 degrees C.; 0 to 2 percent of a stabilizer; and 0 to 5 percent wax.

The polybutylene copolymers employed herein are copolymers of polybutene-1 and ethylene wherein the ethylene content varies from about 5.5 to about 10% by weight of the copolymer. The applicable isotactic polybutylenes are relatively rigid while in their plastic form but flow readily upon being heated. Expressing molecular weight in terms of melt index, the applicable isotactic polybutylenes to be used in the present adhesive should exhibit a melt index in the range of from about 5 to 2000 dg/min and preferably from 400 to 700 dg/min. The latter melt flow values are determined by the method described in ASTM D1238 and are inversely related to molecular weight, i.e., the lower the melt index, the higher the molecular weight. These copolymers are available from Shell Chemical Company under the Duraflex trademark as Duraflex 8310, 8410, 8510 and 8910, with the 8910 having a melt index of about 700, a grade preferred for use herein. Mixtures of these copolymers may also be used.

The tackifying resins which may be used to extend the adhesive properties of the isotactic polybutylene include: (1) hydrogenated wood rosin or rosin ester; (2) polyterpene resins having a softening point, as determined by an ASTM method E28-58 T, of from about 80 degrees C. to 150 degrees C., the latter polyterpene resins generally resulting from the polymerization of terpene hydrocarbons in the presence of Friedel-Crafts catalysts at moderately low temperatures and including the latter resins which are aromatically modified; examples of commercially available resins of this type being the Nirez resins sold by Reichhold Chemical, the Zonatac resins sold by Arizona, and the Piccolyte S-10, S-25, S-40, S-85, S-100, S-115, S-125 and S-135 resins as sold by Hercules Chemical; (3) aliphatic petroleum hydrocarbon resins having a Ball and Ring softening point of from about 80 degrees C. to 160 degrees C., resulting from polymerization of monomers consisting primarily of 5 carbon atom olefins and diolefins, and including the latter resins which are aromatically modified, examples of commercially available resins of this type being Wingtack 95 and Wingtack Extra as sold by the Goodyear Tire and Rubber Company and the Escorez 1000 series of resins sold by the Exxon Chemical Corporation; and (4) partially and fully hydrogenated hydrocarbon resins such as Resin H-130 from Eastman, Escorez 5000 series from Exxon, and Regalrez from Hercules. The amorphous diluents which are needed and present in the adhesive composition include (atactic) amorphous polypropylene or other similar high softening point (i.e. greater than 90 degrees C.), low crystalline diluent, (e.g. amorphous polyalpha-olefins). These diluents, are used at levels of 20 to 50% by weight, preferably about 20 to 25% by weight.

To test the degree of tackiness of the above-described flashing structure, a pull test is performed. An Elvaloy 742 (see paragraph 052, above) 8-inch by 12-inch sample is coated with a hot melt adhesive, namely, APC #915, manufactured by Adhesive Products Company, Indianapolis, Ind. 46235 which hot melt adhesive formulation includes one or more of the aforementioned tackifying resins. A suitable release paper is applied thereover. After a prescribed cure period, the release paper 42 is removed and the device of this invention is applied to the surface of a concrete block. The application to the concrete block is at room temperature utilizing a hand-operated laminating roller to provide the pressure activation. A spring scale is then attached and a 65 lb. force is required to peel the device from the block.

Among the applicable stabilizers or antioxidants utilized herein are included high molecular weight hindered phenols and multifunctional phenols such as sulfur and phosphorous-containing phenols. Representative hindered phenols include: 1,3,5-trimethyl 2,4,6-tris (3,5-di-tert-butyl-4-hydroxy-benzyl)benzene; penta-erythrityl tetrakis-3 (3,5-di-tert-butyl-4-hydroxyphenyl) pro-pionate; 4,4'methylenbis(2, 6-tert-butyl-phenol); 4,4'-thiobis (6-tert-butyl-o-cresol); 2,6-di-tertbutylphenol; 6-(4-hydroxy-phenoxy)-2,4-bis(n-octyl-thio)-1,3,5-triazine; di-n-octadecyl 3, 5-di-tert-butyl-4-hydroxy-benzylphosphonate; 2-(n-octylthio)-ethyl 3, 5-di-tert-butyl-4-hydroxybenzoate; and sorbitol hexa [3-(3, 5-di-tert-butyl-4-hydroxyphenyl)-propionate].

The performance of these antioxidants may be further enhanced by utilizing, in conjunction therewith known synergists such, for example, as thiodipropionate esters and phosphites. Particularly useful is distearylthiodipropionate. These stabilizers are generally present in amounts of about up to 2 weight percent, preferably 0.25 to 1.0%. It is also possible to add minor amounts (i.e. less than about 5% by weight of the formulation) of other diluents such as (1) waxes including petroleum waxes such as a paraffin wax having a melting point of from about 50 degrees C. to 75 degrees C. and microcrystalline wax having a melting point of from about 60 degrees to 90 degrees C.; the latter melting points being determined by ASTM method D127-60; (2) low molecular weight (600 to 3000) liquid polybutene; (3) polyethylene greases having a softening point of from about 80 degrees C. to 100 degrees C. and a hardness value, as determined by ASTM method D-1321, of from about 60 degrees C. to 120 degrees C.; (4) hydrogenated animal, fish and vegetable fats and oil such as hydrogenated tallow, lard, soya oil, cottonseed oil, castor oil, menhaden oil and cod liver oil; and (5) synthetic waxes made by polymerizing carbon monoxide and hydrogen, such as Fischer-Tropsch wax.

In addition, relatively small amounts (less than about 5%) of isotactic polypropylene may be employed as a reinforcing agent. Other additives such as flow modifiers, fibrous additive portion of filamentous fragments, pigments, dyestuffs, etc., which are conventionally added to hot melt adhesives for various end uses may also be incorporated in minor amounts into the formulations of the present invention. The fibrous additive portion provides multidirectional reinforcement for the SSTS device.

Referring again to FIGS. 2 through 4, a metal foil or copper layer 40 is shown. The barrier or metallic layer 40 is constructed of material that is impenetrable by termites and other wood boring insects. The barrier layer 40 has high tensile strength and enhances the puncture- and tear-resistant characteristics of the termite shield. As with copper and bitumen flashing combinations any of the commonly used weights of copper sheeting may be used, including, but not limited to, those in the range of 1 oz/ft$^2$ to 7 oz/ft$^2$. The selection of copper sheeting weight is determined by the parameters of the application and by the desired pliability of the end product. Other metal foils or sheeting may be used and may be selected from aluminum, stainless steel, copper, lead-coated copper, galvanized steel, terne-coated metal, epoxy-coated metal foil, zinc foil, and other metal foils.

Referring now to FIG. 4, the installed SSTS device 30 is shown. The barrier layer has the silicone-treated release sheet 42 removed and has been bent upwards to cover the exposed vertical surface 36 of sill plate 22. The pressure-activated adhesive 48 ensures satisfactory joining and coverage of the sill plate side and, as the barrier layer 40 is impenetrable to termites and wood boring insects, extends the life of the structure.

Figure 5:
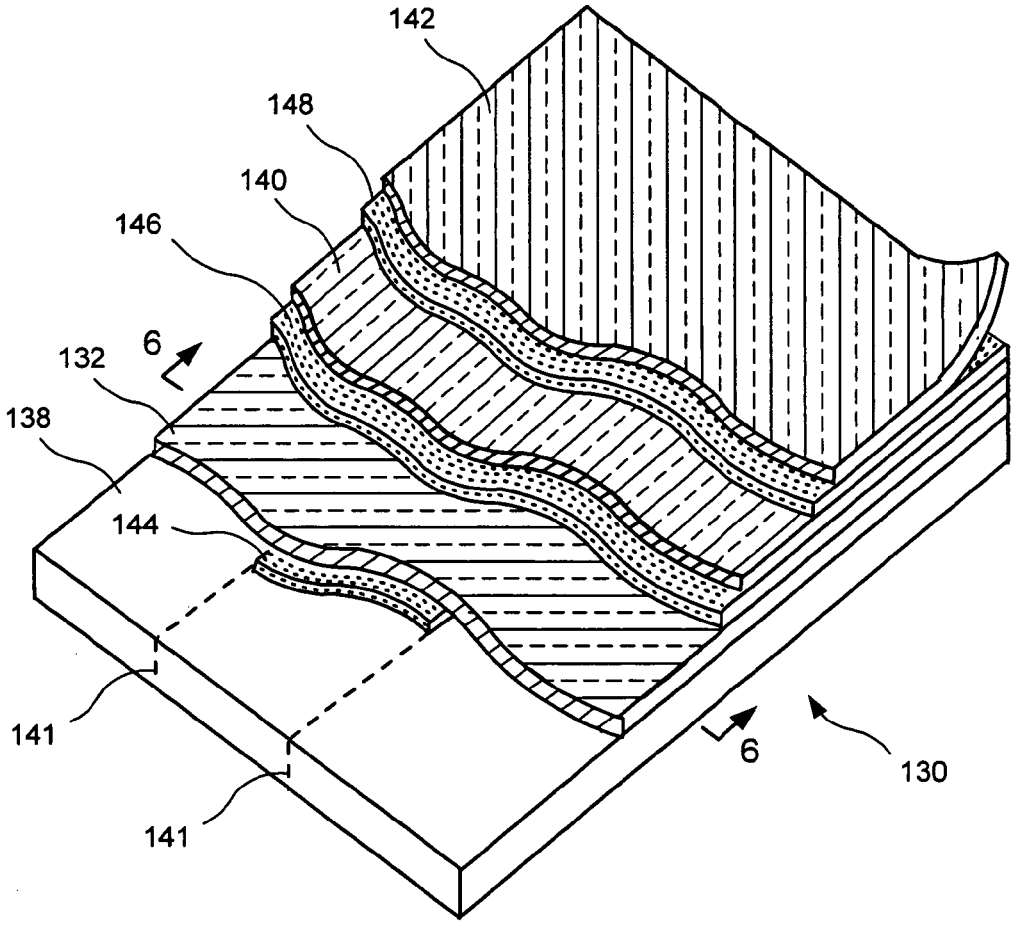
FIG. 5 is a perspective view of a second embodiment of a combined sill seal and termite shield (SSTS) of this invention and is utilizable with the foundation and framing structure shown in FIG. 1, but with a portion of the foam polymer sheet removable.
Figure 6:
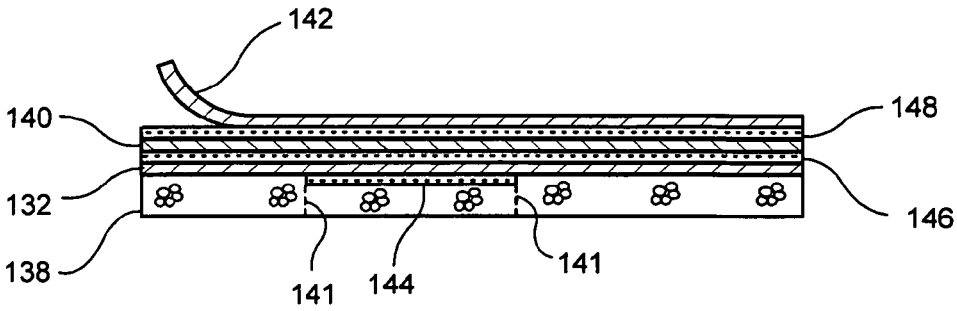
FIG. 6 is a cross-sectional view of the SSTS of FIG. 5.

Referring now to FIGS. 5 and 6, the second embodiment of this invention in which an SSTS device is similarly mounted on poured concrete foundation. The SSTS device referred to generally by the reference designator 130, is shown. In this embodiment, similar parts to those of the first embodiment are referred to by reference designators 100 units higher than a similar part in the first embodiment. Thus, for example, the foam polymer sheet 38 in the first embodiment have analogous foam polymer sheet 138 in the second embodiment. Here, as the SSTS device 130 is designed to function with the foundation structure already shown, and described, the wall and framing details are not repeated. As in the first embodiment attaching hardware secures the framing and particularly the sill plate to the foundation wall. The use of anchor bolt and attaching hardware to secure the sill plate conforms to the requirements of most seismic building codes. This ensures that an earthquake or similarly drastic environmental condition will not result in a framework superstructure sliding off or being otherwise displaced from its position atop the foundation wall.

In this embodiment, an SSTS device, referred to generally by the reference designator 130, is installed in an x-z plane in the same manner as shown in the first embodiment. The SSTS device 130 includes a waterproofing membrane 132 formed from an elongated web of polymeric material namely, a polyethylene film. The waterproofing membrane 132 is constructed for embedment in the joint between the top surface of the foundation wall and the sill plate and for adherence to the vertical sill plate surface in an x-y plane.

In this embodiment the barrier layer or metal film layer 140 is protected at the time of manufacture by a polymeric foam sheet 138 which is coextensive with the barrier layer 140. As such the foam sheet 138 acts as a packaging material during transit to the construction site. Further this structure includes two lines of perforations 141 running longitudinally along the foam sheet 140 (approximating the outer edges of the sill plate. After installation of the SSTS device on the foundation wall, the perforations 141 facilitate the removal of any excess foam sheet 138.

Referring now to FIG. 6 the laminar structure of the SSTS device 130 is shown uninstalled. Optionally, a release sheet 142 forms the SSTS device 130 into a peel-and-stick configuration. The peel-and-stick format simplifies installation and saves labor. As described for the previous embodiment hereof, the SSTS device 130 utilizes the same hot melt adhesive technology for its construction and pressure-activated, hot melt adhesive for its application.

The laminer structure consists of a seven-layer arrangement. When viewing the SSTS device 130 from the foundation upper surface and proceeding toward the sill plate, these layers are:

a. a foam polymer sheet 138—closed cell polyethylene (with parallel perforations 141 at sill plate edges);

b. a hot melt adhesive 146—foam-to-membrane adhesive layer applied within the perforations;

c. a weatherproofing membrane of a polymeric composite 132—a cross-laminated membrane of ethylene vinyl acetate (EVA)

d. a hot melt adhesive layer—weatherproofing membrane-to-metal-foil layer;

e. a metal foil barrier layer 140—stainless steel foil, coextensive with the weatherproofing layer;

f. a pressure-activated, not melt adhesive layer 148—foil-to-sill plate adhesive layer; and, g. a release sheet 142—removed prior to installation.

The polymeric composite of the weatherproofing membrane 132 is a cross laminate from a set of substantially monoaxially oriented thermoplastic polymeric films bonded together in a properly cross position. Cross-laminates exhibit advantageous properties, in particular, better tear resistance than a single-ply films of the same overall thickness and of the same polymer which has been biaxially oriented.

Figure 7:
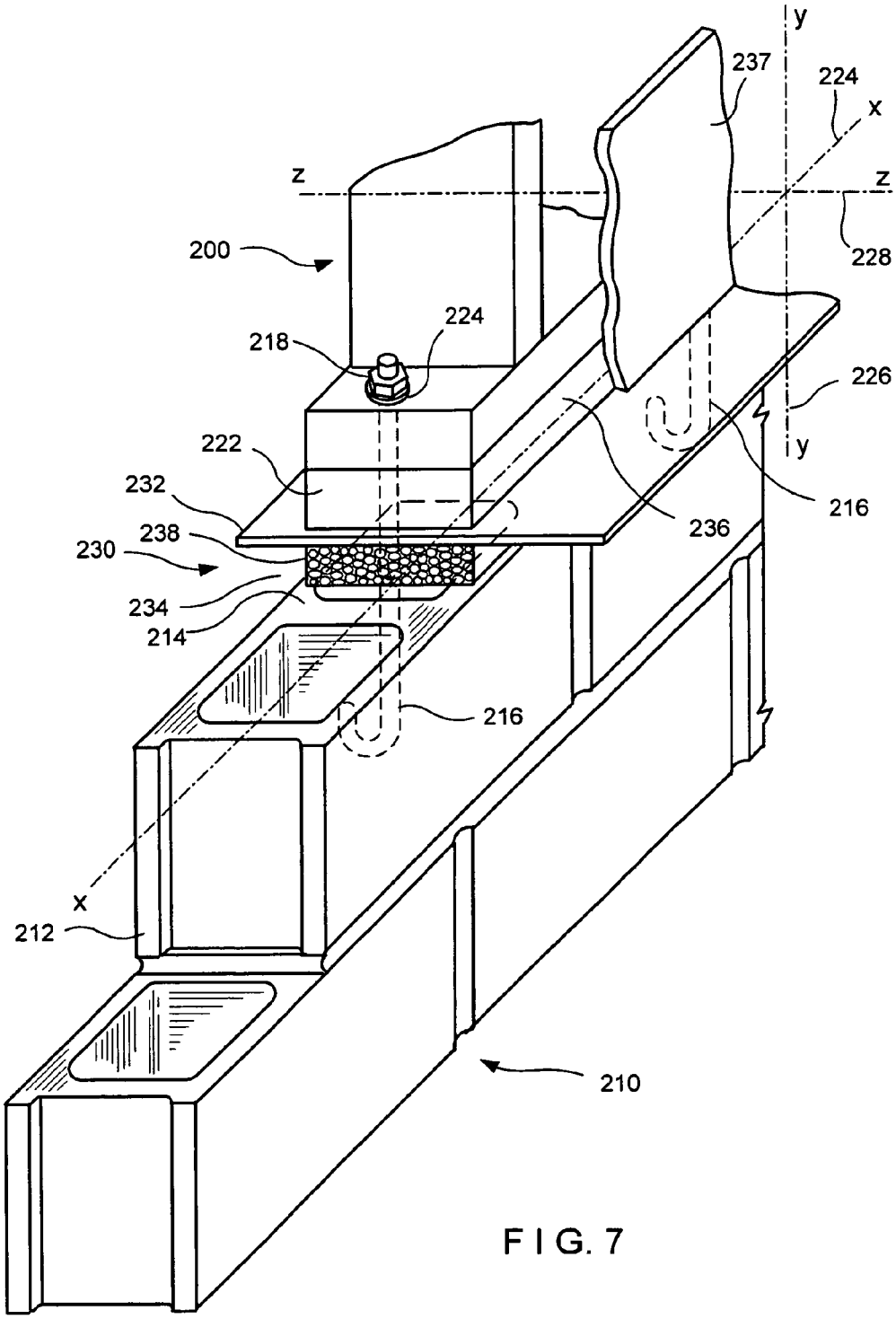
FIG. 7 is a perspective view of a third embodiment of an SSTS of this invention and shows a foundation of masonry block and a composite weatherproofing membrane with a barrier layer therewithin.
Figure 8:
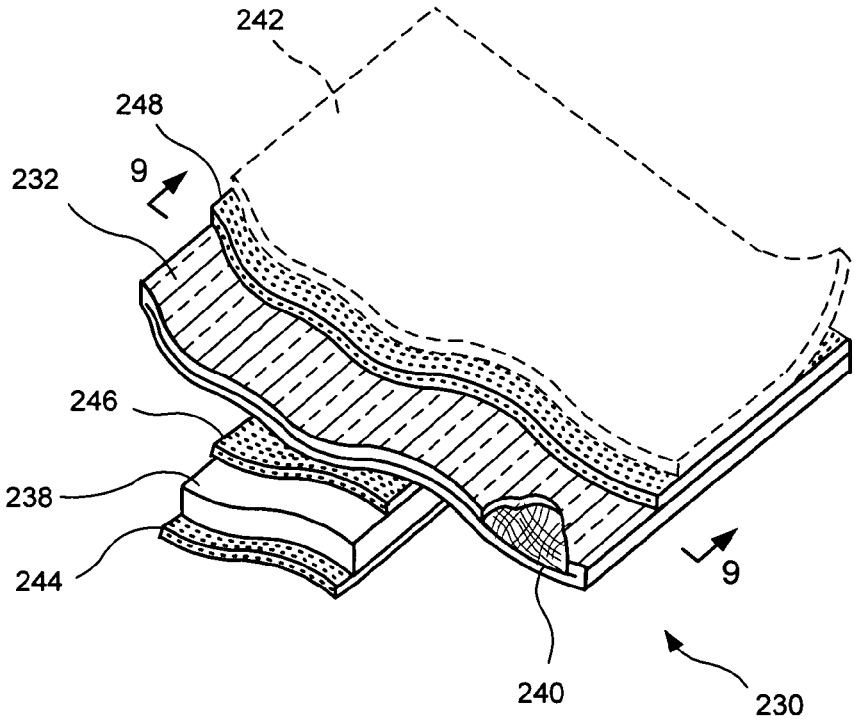
FIG. 8 is a perspective view of the uninstalled peel-and-stick SSTS device of FIG. 7, similar to FIG. 2 but having a unitary weatherproofing membrane and barrier layer.
Figure 9:
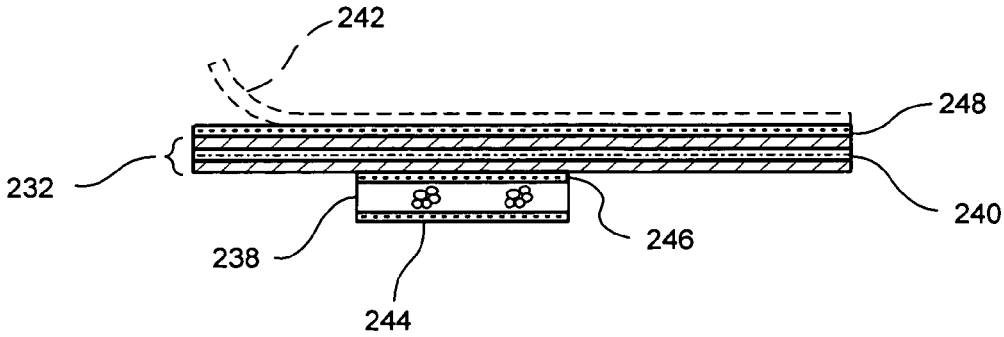
FIG. 9 is a cross-sectional view of the SSTS device of FIG. 8.

Referring now to FIGS. 7, 8 and 9, the third embodiment of this invention in which an SSTS device is mounted on a masonry block foundation, referred to generally by the reference designator 210 is shown. In this embodiment, similar parts to those of the first embodiment are referred to by reference designators 200 units higher than a similar part in the first embodiment. Thus, for example, the anchor bolts 16 in the first embodiment have analogous anchor bolts 216 in the second embodiment. Here a foundation wall structure 212 is shown having an uppermost surface 214 of masonry blocks and mortar filling the cells of the blocks 216 embed anchor bolts 218. Attaching hardware 218 secures the framing 220 and particularly the sill plate 222 thereto. The use of anchor bolt 216 and attaching hardware 218, most commonly a nut and washer, conforms to the requirements of most seismic building codes. This ensures that an earthquake or similarly drastic environmental condition will not result in a framework superstructure sliding off or being otherwise displaced from this portion atop the foundation wall.

For purposes of this discussion, the exterior surface of the foundation wall 212 contains a horizontal line or x-axis 224 and an intersecting vertical line or y-axis 226. A horizontal line or z-axis 228 also passes through the coordinate origin formed by the intersection x- and y-axes. In the discussion which follows, it will be seen that the sill seal and termite device 230 of this invention is constructed to completely to completely seal the previously described juncture and to preclude termites and other wood boring insects from destroying the sill plate 222 of the framework 220.

Along the uppermost surface 214, in this embodiment, an SSTS device, referred to generally by the reference designator 230, is installed in an x-z plane as shown. The SSTS device 230 includes a waterproofing membrane 232 formed from an elongated web of elastomeric material. The waterproofing membrane 232 is constructed for embedment in joint 234 in an x-z plane and for adherence to the vertical sill plate surface 236 in an x-y plane. The waterproofing membrane 232 thereby sealing cavity 222, and for embedment in bed joint 228 in an x-z plane. In this preferred mode, it is seen that the membrane 232 is installed exterior to insulation 237.

In addition to membrane 232, the SSTS device 130 includes a foam pad or sill seal 238, and a barrier layer or termite shield 140. In this mode, the termite shield 240 is a scrim constructed of a nonmetallic material such as a woven or nonwoven fiber glass layer may be used and is emplaced within the waterproofing membrane 232. The sill seal 238 is described in greater detail hereinbelow.

Referring now to FIG. 8 the laminer structure of the SSTS device 230 is shown uninstalled. Optionally, a release sheet 242 forms the SSTS device 230 into a peel-and-stick configuration. The peel-and-stick format simplifies installation and saves labor. As described for the first embodiment hereof, the SSTS device 230 utilizes the same hot melt adhesive technology for its construction and pressure-activated, hot melt adhesive for its application.

Thus, the waterproofing membrane 232 of this embodiment is an elastomeric composite layer comprised of a first elastomeric sheet or carrier 233 which serves as a base layer upon which is disposed a nonmetallic barrier layer 240. The barrier layer 240, besides being impenetrable by termites and other wood boring insects, is constructed to the tear and puncture resistance of the overall composite. The barrier layer 240 may be a woven or nonwoven technical textile, preferably fiber glass, or may be filaments randomly arranged upon carrier 233.

In general, it is preferred that the composite 232 contain at least one material selected from the group consisting of ethylenepropylene diene monomer, polyisobutylene, chlorinated polyethylene, natural rubber, polyvinyl chloride, ethylene vinyl acetate, and chlorosulfonated polyethylene. A specifically preferred formulation for the elastomeric sheet includes about 10 to 40 percent by weight of unplasticized polyvinyl chloride, and about 10 to 40 percent by weight of an ethylene vinyl acetate carbon monoxide terpolymer. The elastomeric sheet may also contain up to about 15 percent of primary or secondary plasticizer with, or without, up to about 10 percent of processing aids or stabilizers.

In the elastomeric composite 232 the amount of polyvinyl chloride is preferably in the range of about 20 to 30 percent by weight of the entire composition and may advantageously be provided as a suspension or emulsion grade of polyvinyl chloride. The ethylene vinyl acetate carbon monoxide terpolymer may contain about 15 to 85 percent ethylene, about 5 to 60 percent vinyl acetate, and 0.5 to 30 percent carbon monoxide, all on a weight basis. A suitable terpolymer for use in this context is that marketed by E. I. Du Pont de Nemours & Company under the trademark Elvaloy, with the preference being for Elvaloy KEE or, in the alternative, Elvaloy 742. It is within the contemplation of this invention that elastomeric carrier 232, barrier layer 240, and elastomeric covering layer 235 may be replaced by a suitable long-fiber reinforced elastomeric body having, when formed into a membrane of similar flexibility and toughness.

The laminer structure consists of a five-layer arrangement. When viewing the SSTS device 230 from the foundation upper surface 214 and proceeding toward the sill plate 222 these layers are:

a. pressure-activated hot melt adhesive (foundation-to-foam adhesive layer) 244;

b. foam polymer sheet 238;

c. hot melt adhesive (foam-to-membrane adhesive layer) 246—APC #915;

d. waterproofing membrane—elastomeric composite 232, including barrier layer 240 therewithin; and, e. pressure-activated, hot melt adhesive 248 (foil-to-sill-plate layer)—APC #915.

Figure 10:
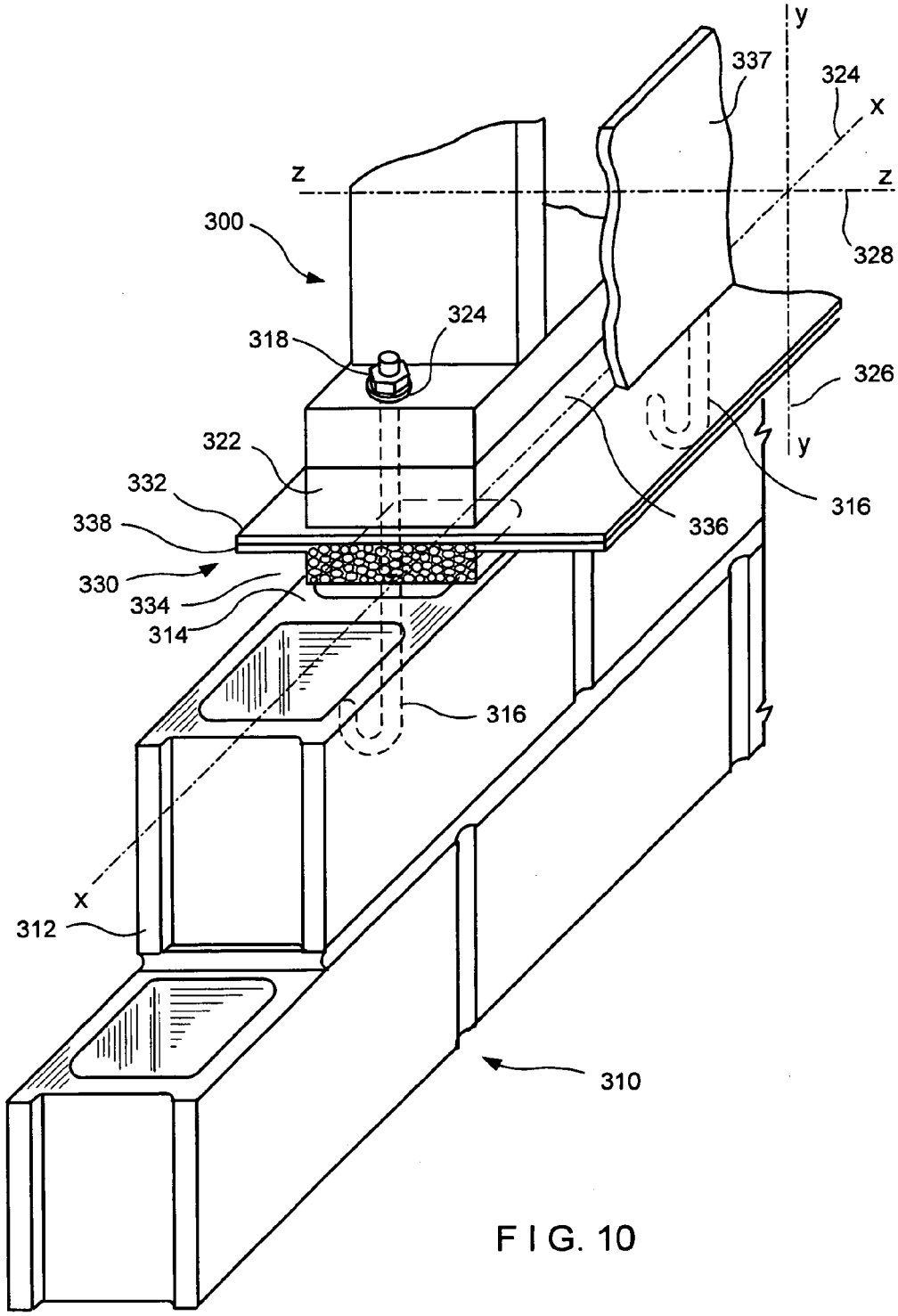
FIG. 10 is a perspective view of a fourth embodiment of a combined sill seal and termite shield (SSTS) of this invention and is utilizable with the foundation and framing structure shown in FIG. 7, but with a portion of the foam polymer sheet formed into a weatherproofing membrane.
Figure 11:
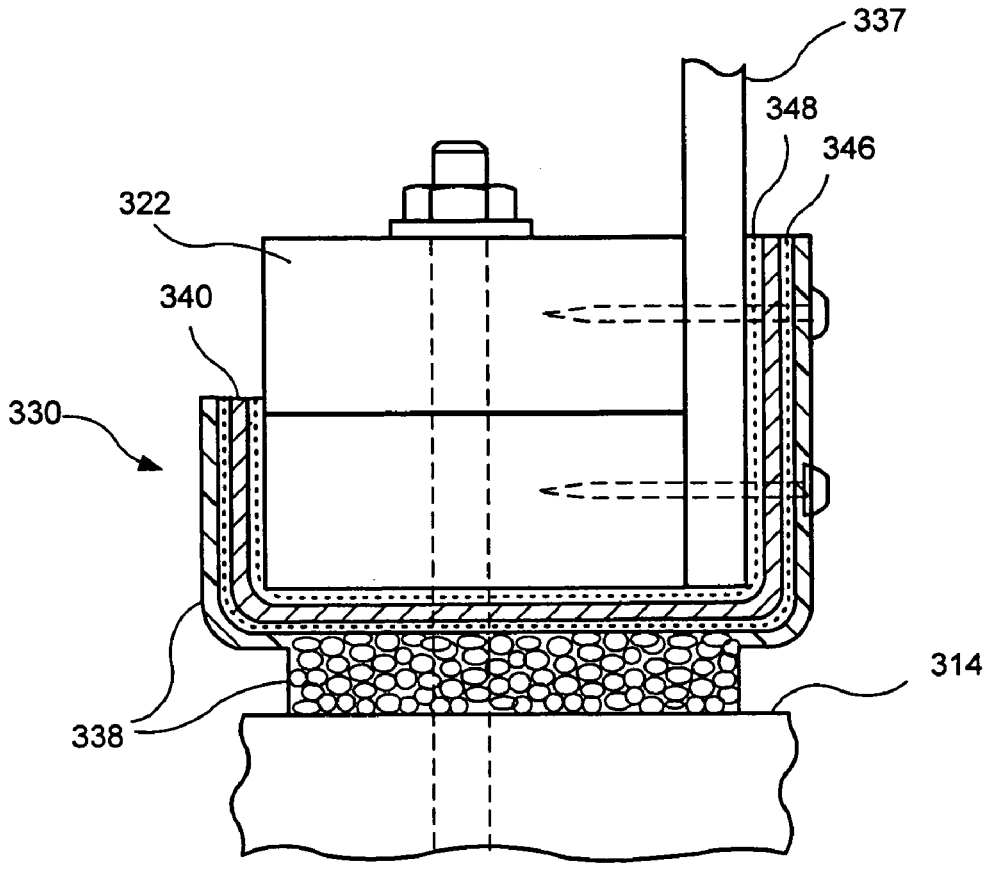
FIG. 11 is a cross-sectional view of the SSTS of FIG. 10.

Referring now to FIGS. 10 and 11, the fourth embodiment of this invention in which an SSTS device is similarly mounted on masonry block foundation. The SSTS device referred to generally by the reference designator 330, is shown. In this embodiment, similar parts to those of the first embodiment are referred to by reference designators 300 units higher than a similar part in the first embodiment. Thus, for example, the foam polymer sheet 38 in the first embodiment have analogous foam polymer sheet 338 in the fourth embodiment. Here, as the SSTS device 330 is designed to function with the foundation structure already shown and described, the wall and framing details are not repeated. As in the prior embodiments attaching hardware secures the framing and particularly the sill plate to the foundation wall. The use of anchor bolts and attaching hardware to secure the sill plate conforms to the requirements of most seismic building codes. This ensures that an earthquake or similarly drastic environmental condition will not result in a framework superstructure sliding off or being otherwise displaced from its position atop the foundation wall.

In this embodiment, an SSTS device, referred to generally by the reference designator 330, is installed in an x-z plane in the same manner as shown in the first embodiment. The SSTS device 330 includes a waterproofing membrane 332 formed from an elongated web of polymeric material namely, a polyethylene film. The waterproofing membrane 332 is constructed for embedment in the joint between the top surface of the foundation wall and the sill plate, and for adherence to the vertical sill plate surface in an x-y plane.

The SSTS device 330 includes a unitary weatherproofing membrane 332 and a foam polymer sheet or sill seal 338. In crafting a unitary structure a foam polymer sheet 338 that is coextensive the barrier layer 340 is processed so as to collapse the outer cellular portions. This is accomplished using heat or pressure or a combination thereof. The central foam portion 338 left intact is approximately equal to the width of the sill plate.

Referring now to FIG. 11 the laminar structure of the SSTS device 330 is shown uninstalled. Optionally, a release sheet 342 forms the SSTS device 330 into a peel-and-stick configuration. The peel-and-stick format simplifies installation and saves labor. As described for the previous embodiment hereof, the SSTS device 330 utilizes the same hot melt adhesive technology for its construction and pressure-activated, hot melt adhesive for its application.

The lamina structure consists of a five layer arrangement. When viewing the SSTS device 330 from the foundation upper surface and proceeding toward the sill plate, these layers are:

a. a combined foam polymer sill seal 338 and weatherproofing membrane 332 formed from an elongated foam web with the foam on the outer portions thereof collapsed;

b. a hot melt adhesive 346—sill-seal/membrane-to-barrier layer;

c. metal foil barrier layer 340—copper— d. a pressure-activated, hot melt adhesive layer 348—barrier-to-sill plate adhesive; and, e. an optional release sheet 342—removed prior to installation.

Figure 12:
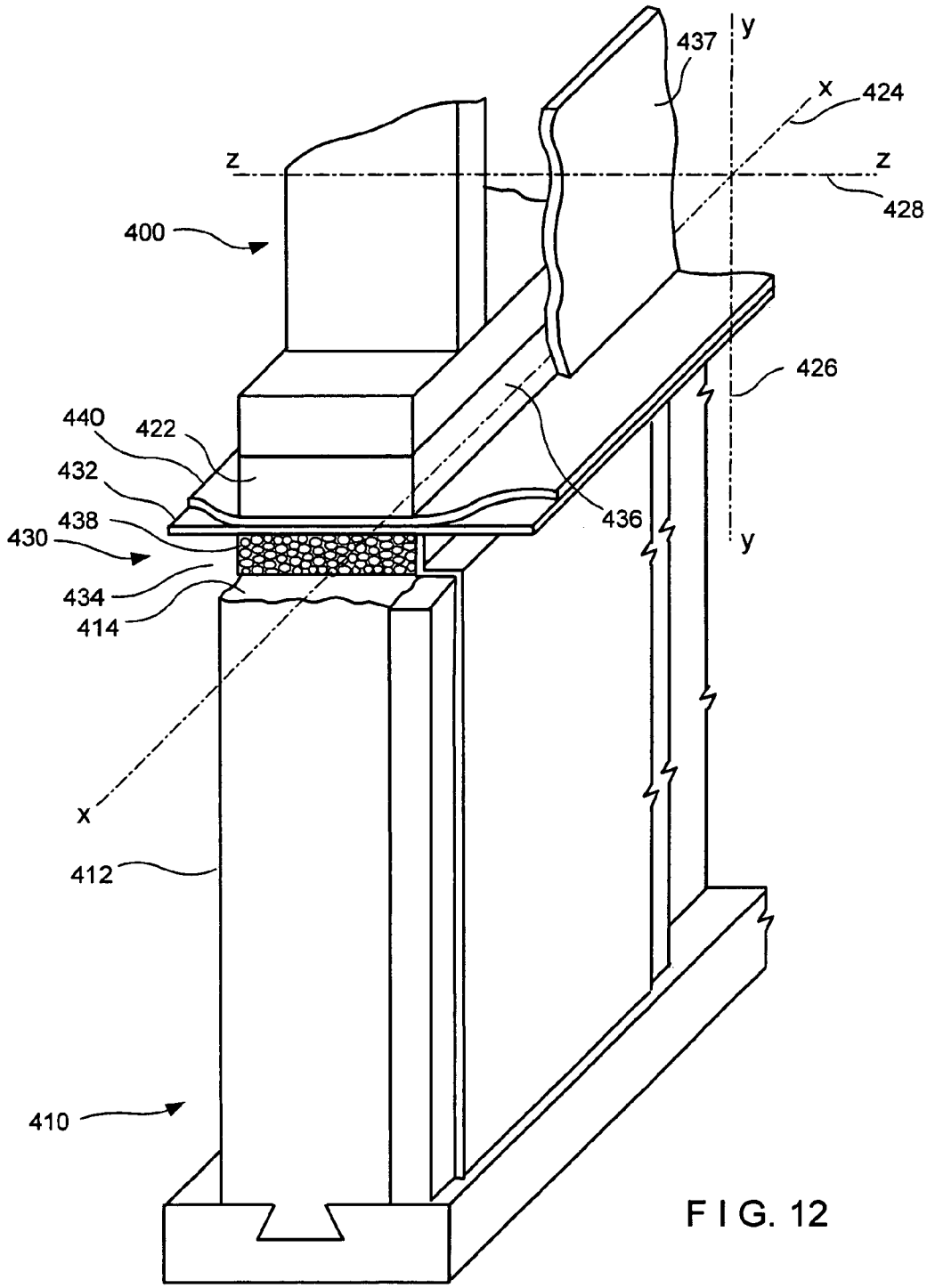
FIG. 12 is a perspective view of a fifth embodiment of an SSTS device of this invention applied to a frost-protected shallow foundation of poured concrete with rigid insulation thereabout and a composite weatherproofing membrane with a barrier layer therewithin.
Figure 13:
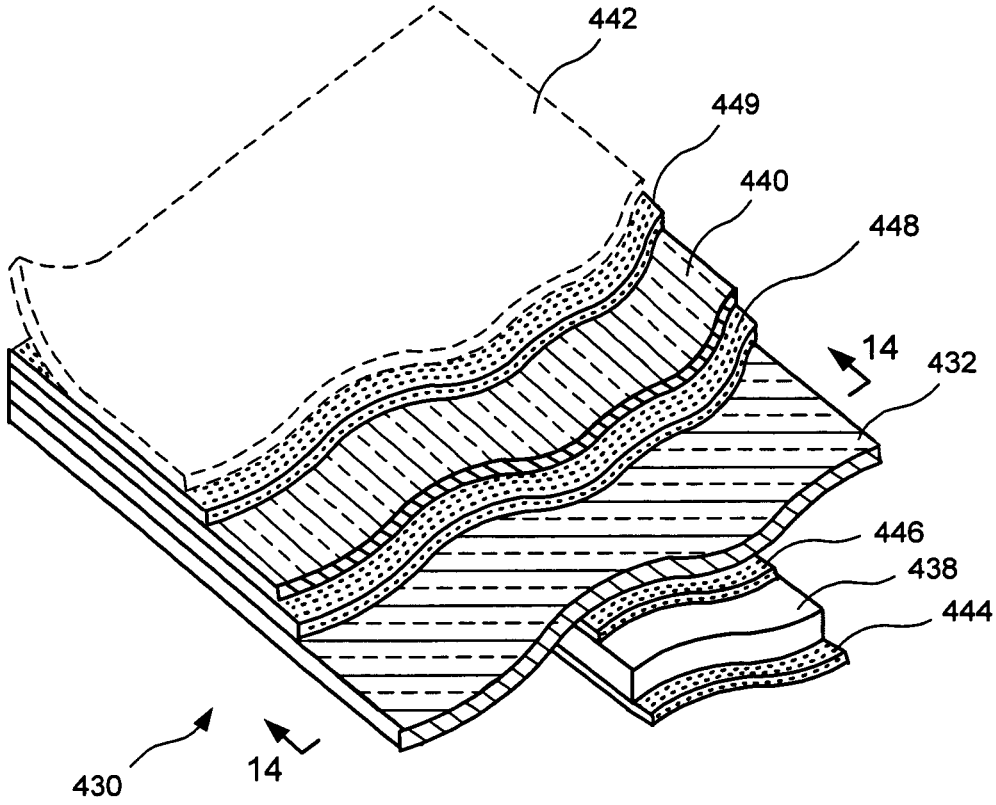
FIG. 13 is a perspective view of the uninstalled peel-and-stick SSTS device of FIG. 12, similar to FIG. 2 but having a weatherproofing membrane that seals to the insulation; and, FIG. 14 is a cross-sectional view of the SSTS device of FIG. 13.
Figure 14:
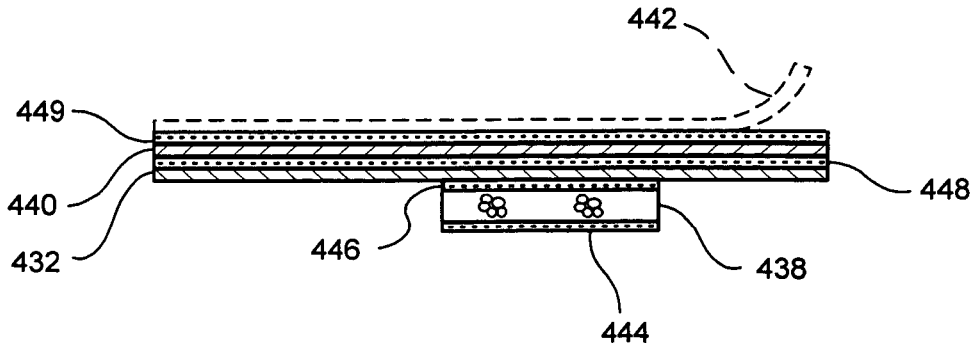

Referring now to FIGS. 12, 13 and 14, the fifth embodiment of this invention is shown. An SSTS device, referred to generally by the reference designator 430, is installed in a frost-protected shallow foundation (FPSF) environment. In this embodiment and external to the poured concrete, the FPSF uses a 16-inch panel of rigid foam insulation with a waterproof cover thereover. Here the application does not conform to seismic building codes and no anchor bolts are used; however a continuous band of pressure-activated hot melt adhesive joins the sill plate to the uppermost surface of the FPSF. In FIGS. 12, 13 and 14 parts similar to those in the first embodiment are referred to by reference designators 400 units higher than a similar part in the first embodiment. Thus, for example, the metal foil barrier layer 40 has an analogous metal foil barrier layer 440 in the third embodiment.

Referring now to FIGS. 13 and 14 the relationship between the weatherproofing membrane 432 and the barrier layer 440 is shown. The membrane 432, while being shown in FIGS. 13 and 14 is suitable for mounting atop the foundation upper surface 414 of the FPSF. Like the first embodiment, the laminar structure consists of a seven-layer arrangement. When viewing the uninstalled SSTS device 430 from the upper surface 414 and proceeding toward the sill plate 422 these layers are:

a. pressure-activated hot melt adhesive (foundation-to-foam adhesive layer) 444;

b. foam polymer sheet 438;

c. pressure-activated hot melt adhesive (foam-to-weatherproofing membrane and weatherproofing-to-insulation adhesive layer) 446;

d. waterproofing membrane 432;

e. hot melt adhesive (internal adhesive layer) 448;

f. stainless steel, sheet type 304SS barrier layer 440; and g. pressure-activated, hot melt adhesive (barrier-to-sill-plate adhesive layer) 449.

The SSTS device of this embodiment seals the weatherproofing membrane to the foundation wall insulation. The barrier layer 440, which is type 304SS stainless steel (between 22 to 32 gauge) seals to the exposed surface of the sill plate 422 as seen in FIG. 9. Upon installation of the SSTS device of this embodiment, the waterproofing membrane is turned outward and downward until meeting the covering layer of the foundation insulative layer.

Because of environmental and flammability concerns with traditional solvent-based adhesives and an invested position in bitumen-containing materials, the building construction industry has been slow to adopt hot melt adhesive compositions for application of building materials. Now, with the recent advances in hot melt adhesives technology incorporated into the above application advantages over solvent-based or bitumen systems are created hereby. Thus, the SSTS device described above has the requisite termite impenetrability and the tear and puncture resistance. Additionally, the hot melt adhesives meet the fire retardancy and adhesiveness requirements, the previous barriers to use have been removed. It is further appreciated that the advance in the art is remarkable as the hot melt adhesives hereof do not contain flammable solvents and thereby do not cause the environmental concerns of the solvent-based systems.

The adhesives employed in the SSTS device of this invention exhibit temperature stability superior to that of bitumen materials and do not break down at high ambient temperatures. In addition, the pressure-activated hot melt adhesives set up immediately and reduce the time required for installation. Thus, the bonding of hot melt adhesives to masonry surfaces is immediate and unlike bitumen materials are not dependent on ambient temperatures for cure purposes. This translates into greater quality construction and easier assurance thereof. Another advantage of hot melt adhesives is their economy and applicability to peel-and-stick structures.

By the foregoing embodiments described herein, a combined sill seal and termite shield is introduced that concurrently fulfills the objectives of providing: (1) a polymeric foam that conforms to the rough uppermost surface of the foundation wall; (2) continuity of weatherproofing; and, (3) a sill plate barrier to termites and other wood boring insects. Other benefits hereof are expressed in the attached claims.

What is claimed is:

1. A foundation system including a sill seal and termite shield (SSTS) device, said foundation system comprising: a foundation wall with a sill plate thereon and framing arising therefrom; said SSTS comprising:

a sill seal strip of polymeric foam, said polymeric foam interspersed into the interstices of said foundation wall surface, said sill seal strip being an elongated web with two major surfaces and a longitudinal axis;

a barrier layer disposed on said sill seal strip, said barrier layer impenetrable by wood boring insects, said barrier layer, in turn, comprising:

an outer portion thereof dimensioned to extend beyond the base of said sill plate;

and, a weatherproofing membrane formed from an elongated web of polymeric material, said web having two major surfaces and a longitudinal axis and disposed on and adhered to said sill seal strip, said weatherproofing membrane having said barrier layer disposed on one of said two major surfaces of said sill seal strip;

whereby, upon installation of said SSTS device on said foundation wall and said sill plate on said SSTS device, said SSTS device seals the juncture of said sill plate and said foundation wall with said polymeric foam and enwraps the sides of said sill plate with the said outer portion of said barrier layer.

2. An SSTS device as described in claim 1 further comprising:

an adhesive layer disposed on said weatherproofing membrane and adhered to said barrier layer, said adhesive layer disposed on said weatherproofing membrane on the major surface opposite said seal strip.

3. An SSTS device as described in claim 2 further comprising a pressure-activated adhesive layer disposed on said barrier layer on the side opposite said weatherproofing membrane and adapted upon pressure activation to durably adhere said SSTS device to the surfaces of said sill plate.

4. An SSTS device as described in claim 3 wherein said pressure-activated adhesive layer further comprises:

a butylated adhesive portion admixed with a hot melt adhesive, said butylated adhesive forming between 5 and 40 percent thereof while maintaining the melting point of the cured adhesive above 200° F.

5. An SSTS device as described in claim 3 wherein said pressure-activated layer further comprises:

a release sheet adhered to said pressure-activated adhesive layer, said release sheet being removable prior to mounting said sill plate on said SSTS device.

6. An SSTS device as described in claim 1 wherein said polymeric foam is selected from a group consisting of non-cross-linked polyethylene foam, closed cell polyethylene foam, and low density polyethylene foam.

7. A SSTS device as described in claim 6 wherein said barrier layer is a metal lamina of material selected from a group consisting of copper, aluminum, stainless steel, lead-coated copper, galvanized steel, terne-coated metal, epoxy-coated metal foil, and zinc foil.

8. A foundation system including a sill seal and termite shield (SSTS) device, said foundation system comprising: a foundation wall with a sill plate thereon and framing arising therefrom; said SSTS comprising:

a sill seal strip of polymeric foam, said polymeric foam interspersed into the interstices of said foundation wall surface, said sill seal strip being an elongated web with two major surfaces and a longitudinal axis;

a weatherproofing membrane formed from an elongated web of polymeric material, said web having two major surfaces and a longitudinal axis and disposed on and adhered to said sill seal strip; and, a metal lamina disposed on said sill seal strip, said metal lamina impenetrable by wood boring insects, said metal lamina, in turn, comprising:

an outer portion thereof dimensioned to extend beyond the base of said sill plate;

whereby, upon installation of said SSTS device on said foundation wall and said sill plate on said SSTS device, said SSTS device seals the juncture of said sill plate and said foundation wall with said polymeric foam being interspersed into the interstices of the foundation wall surface and further and enwraps the sides of said sill plate with the said outer portion of said metal lamina.

9. An SSTS device as described in claim 8 further comprising a pressure-activated adhesive layer disposed on said metal lamina on the side opposite said weatherproofing membrane and adapted upon pressure activation to durably adhere said SSTS device to the surfaces of said sill plate.

10. An SSTS device as described in claim 9 wherein said adhesive layer is a hot melt adhesive with sufficient tack to adhere said SSTS device to the surface of said sill plate, said adhesive layer comprises about 10 to 50 percent by weight of an isotactic thermoplastic, about 5.5 to 10 percent by weight of ethylene, about 20 to 50 percent of a tackifier resin; 15 to 50 percent by weight of an amorphous diluent; 0 to 2 percent by weight of a stabilizer; and 0 to 5 percent by weight of wax.

11. An SSTS device as described in claim 10 wherein each said adhesive layer further comprises:

a fibrous additive portion of filamentous fragments, said fibrous additive portion providing multidirectional reinforcement to said SSTS device.

12. An SSTS device as described in claim 8 wherein said polymeric foam is selected from a group consisting of non-cross-linked polyethylene foam, closed cell polyethylene foam, and low density polyethylene foam.

13. An SSTS device as described in claim 9 wherein said pressure-activated layer further comprises:

a release sheet adhered to said pressure-activated adhesive layer, said release sheet being removable prior to mounting said sill plate on said SSTS device.

14. A SSTS device as described in claim 13 wherein said metal lamina is selected from a group consisting of copper, aluminum, stainless steel, lead-coated copper, galvanized steel, terne-coated metal, epoxy-coated metal foil, and zinc foil.

15. A foundation system including a sill seal and termite shield (SSTS) device, said foundation system comprising: a foundation wall with a sill plate thereon and framing arising therefrom; said SSTS comprising:

a sill seal strip of polymeric foam, said polymeric foam interspersed into the interstices of said foundation wall surface, said seal strip having a longitudinal axis;

a waterproofing membrane formed from an elongated web of elastomeric material, said web having two major surfaces and a longitudinal axis, said waterproofing membrane disposed on and adhered to said sill seal strip, said waterproofing membrane, upon disposition, having said longitudinal axis thereof substantially parallel to said longitudinal axis of said sill seal strip;

a barrier layer disposed on and coextensive with said waterproofing layer, said barrier layer impenetrable by wood boring insects;

a pressure-activated adhesive layer disposed on said waterproofing membrane and said barrier layer, said SSTS device received thereon said sill plate, to adhere the barrier layer to said sill plate, and to seal the juncture of said sill plate and said foundation wall; and, a release sheet adhered to said pressure-activated adhesive layer, said release sheet being removable prior to mounting said sill plate on said SSTS device.

16. An SSTS device as described in claim 15 wherein said polymeric foam is selected from a group consisting of non-cross-linked polyethylene foam, closed cell polyethylene foam, and low density polyethylene foam.

17. A SSTS device as described in claim 15 wherein said barrier layer is a metal lamina of material selected from a group consisting of copper, aluminum, stainless steel, lead-coated copper, galvanized steel, terne-coated metal, zinc foil, and epoxy-coated metal foil.

* * * * *

UNITED STATES PATENT AND TRADEMARK OFFICE

CERTIFICATE OF CORRECTION

PATENT NO. : 7,603,816 B1
APPLICATION NO. : 11/236136
DATED : October 20, 2009
INVENTOR(S) : Ronald P. Hohmann, Jr.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 707 days.

Signed and Sealed this

Fifth Day of October, 2010

David J. Kappos

David J. Kappos
*Director of the United States Patent and Trademark Office*